US005091714A

United States Patent [19]

de Solminihac

[11] Patent Number: 5,091,714

[45] Date of Patent: Feb. 25, 1992

[54] SYSTEM FOR THE PREVENTION OF DROWNING ACCIDENTS

[75] Inventor: Francois de Solminihac, Brest, France

[73] Assignee: Thomson-CSF, Paris, France

[21] Appl. No.: 674,310

[22] Filed: Mar. 25, 1991

Related U.S. Application Data

[63] Continuation of Ser. No. 426,584, Oct. 25, 1989, abandoned.

[30] Foreign Application Priority Data

Oct. 28, 1988 [FR] France ..... 8814140

[51] Int. Cl.[5] ..... G08B 21/00

[52] U.S. Cl. ..... 340/573; 340/539; 4/504; 441/89

[58] Field of Search ..... 340/573, 539, 604; 441/89, 88, 80; 4/504, 499, 507-509; 73/754

[56] References Cited

U.S. PATENT DOCUMENTS

| | | | |
|---|---|---|---|
| 2,832,915 | 4/1958 | McCoy | 315/168 |
| 2,942,247 | 6/1960 | Lienau et al. | 340/660 |
| 3,810,146 | 5/1974 | Lieb | 340/541 |
| 4,129,905 | 12/1978 | Niemirow | 4/499 |
| 4,305,143 | 12/1981 | Simms et al. | 340/573 |
| 4,630,205 | 12/1986 | Otaka | 441/80 |
| 4,714,914 | 12/1987 | Boe | 340/573 |
| 4,747,168 | 5/1988 | Sing | 04/504 |
| 4,813,025 | 3/1989 | Rowland et al. | 441/89 |
| 4,842,957 | 6/1989 | Yamamoto et al. | 73/754 |
| 5,006,831 | 4/1991 | de Solminihac | 340/573 |

FOREIGN PATENT DOCUMENTS

| | | | |
|---|---|---|---|
| 2609961 | 7/1988 | France . | |
| 0252724 | 11/1986 | Japan | 340/573 |

*Primary Examiner*—Glen R. Swann, III
*Attorney, Agent, or Firm*—Cushman, Darby & Cushman

[57] ABSTRACT

A device for the prevention of drowning accidents based on the principle of underwater acoustic transmission consists in equipping an acoustic transmitter which communicates with at least one hydrophone placed at the bottom of the water, the hyrophone being connected to an alarm or to adapted rescue means.

9 Claims, 1 Drawing Sheet

SYSTEM FOR THE PREVENTION OF DROWNING ACCIDENTS

This is a continuation of application Ser. No. 07/426,584, filed on Oct. 25, 1989, which was abandoned upon the filing hereof.

BACKGROUND OF THE INVENTION

1. Field of the Invention

The present invention relates to the field of life-saving in swimming-pools or in the sea and to the surveillance of beaches.

2. Description of the Prior Art

For sea rescue work, equipment for the prevention of drowning accidents as employed in accordance with conventional practice essentially consists of a VHF radio transmitter set. When a person equipped with a radio transmitter of this type falls into the sea, the transmitter is turned-on by a means for closing a contact by conduction of water and transmits a VHF signal which triggers the alarm or emergency aid means. However, this system is unreliable since it operates only when the person is not totally submerged.

The problem to be solved in a swimming-pool and for the surveillance of beaches is to be able to make a distinction between a normal bather (even if he or she remains underwater for a fairly long time) and a submerged person who is in danger of drowning. Since radio waves propagate only very weakly underwater, the use of a radio transmitter alone is not sufficient for life-saving in a swimming-pool or in the vicinity of beaches.

SUMMARY OF THE INVENTION

In order to solve this problem, the system for prevention of drowning accidents in accordance with the invention essentially comprises :

- at least one water-tight casing intended to be carried by a bather on his or her wrist, for example, and comprising a submersion detector for triggering an electronic counter connected to a comparator which controls an acoustic transmitter, said transmitter being turned-on above a predetermined threshold value,
- at least one hydrophone placed at the bottom of the water for picking-up any acoustic waves,
- an alarm control unit and/or rescue means connected to the hydrophone by a water-tight cable.

DESCRIPTION OF THE PREFERRED EMBODIMENT

Figure 1:
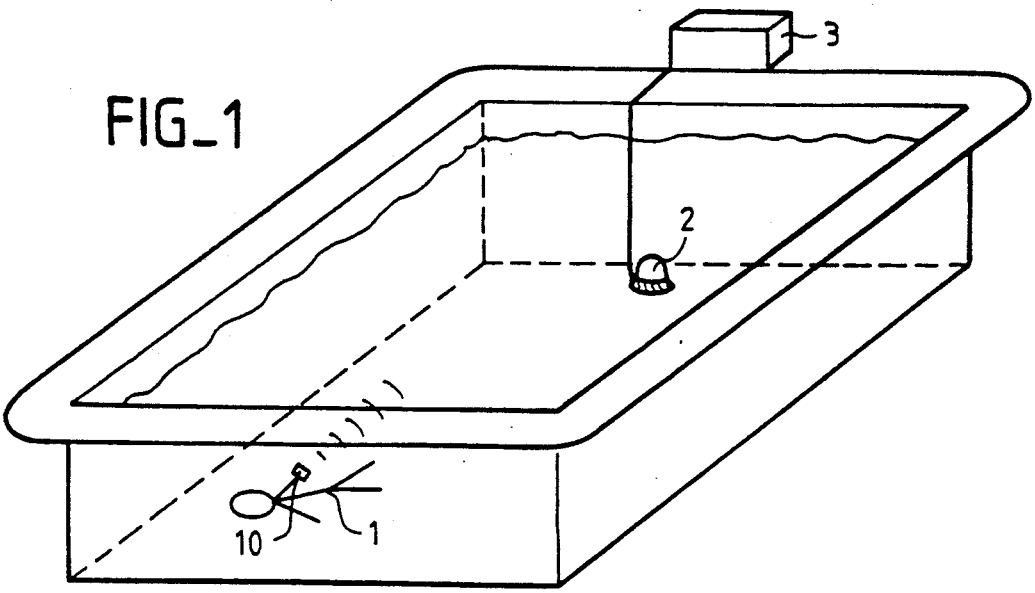
FIG. 1 is a diagram of a swimming-pool equipped in accordance with the invention.

FIG. 1 illustrates a swimming-pool equipped with the following life-saving device : a bather 1 carries on his or her wrist a water-tight casing 10 mainly comprising a small acoustic transmitter and an associated electronic circuit. A hydrophone 2 is placed on or attached to the bottom of the swimming-pool and connected to a unit 3 for controlling any suitable type of alarm system or to adapted rescue means.

Figure 2:
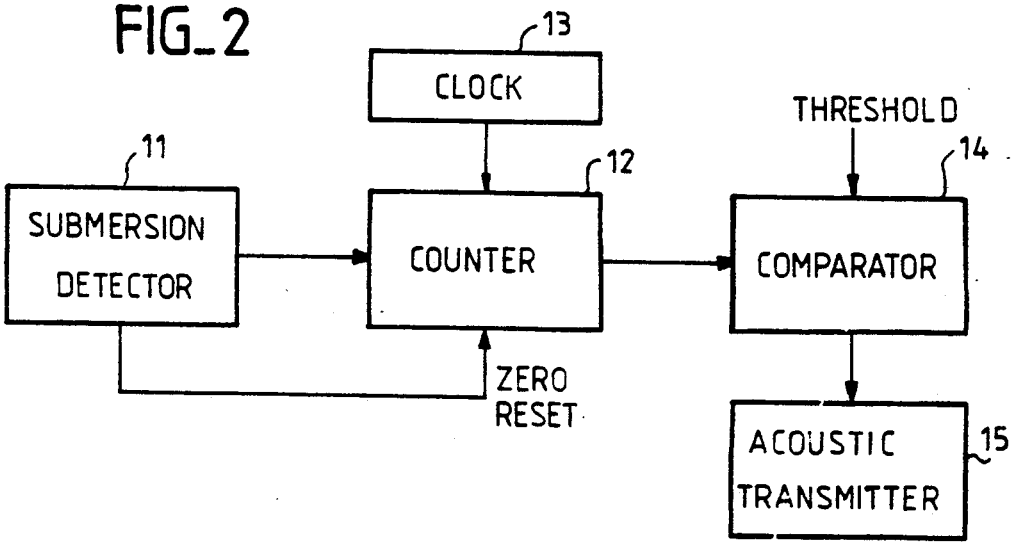
FIG. 2 is a block diagram of the electronic system of the water-tight casing.

FIG. 2 illustrates the electronic circuit of the water-tight casing 10 comprising a submersion detector 11 which triggers a counter 12 time-controlled by a clock 13. Said clock can be reset by a control signal derived from the submersion detector 11. The output of said counter 12 is connected to a comparator 14 and compared with a threshold value corresponding to a predetermined time interval. The output of the comparator controls an acoustic transmitter 15.

Submersion detection can be obtained in several different ways. The most simple version comprises a contact which is closed by water : each time the current flows, it triggers the counter.

Submersion detection can also be obtained from a pressure sensor consisting of a pastille of resistive material which is variable as a function of pressure, for example a silicon pastille fixed on the water-tight casing. Triggering of the counter takes place when the pressure varies.

In order to achieve enhanced reliability, submersion detection can also be obtained in an active manner, on the one hand by equipping the alarm unit of a VHF radio transmitter containing an antenna and on the other hand by equipping the water-tight casing with a VHF receiver. Since VHF radio waves do not propagate underwater, submersion detection is obtained by absence of positive VHF reception, that is, when the level of VHF reception is below a predetermined level.

In order to increase the bather's safety and to provide a remedy for possible failures, the three types of submersion detection described earlier can coexist, the counter being activated when one of the conditions is satisfied. The principle of operation is as follows : each time the water-tight casing is submerged, electronic counting begins. The counter is reset to zero at each interruption of submersion. When counting exceeds a stop value, an acoustic emission is initiated. This emission is received by the hydrophone which transmits a signal to the alarm unit or the rescue means provided. The transmitter is omnidirectional and its transmission frequency is sufficiently high to be located outside the frequency band of swimming-pool noise (10 kHz, for example).

Figure 3:
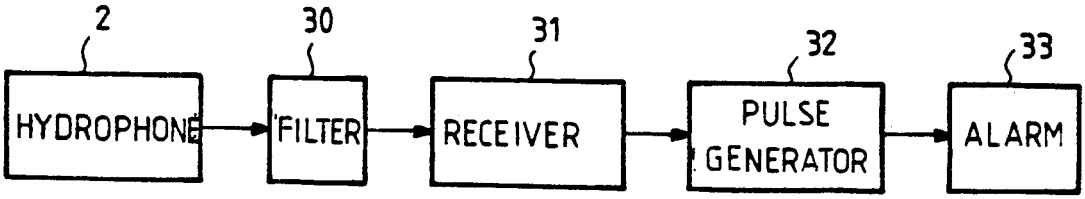
FIG. 3 is a block diagram of the alarm unit.

FIG. 3 shows the electronic circuit of the alarm unit 3. This unit is portable, water-tight and does not have any particular characteristics with respect to a conventional residential building alarm system. The unit 3 has a selective filter 30 for eliminating swimming-pool noise, said filter being connected to a receiver 31 which controls a pulse generator 32 and this latter triggers an alarm 33 or rescue means. Said unit provides selective reception by filtering of the electric signal delivered by the hydrophone. Provision can also be made for regular self-testing which makes it possible to check the good operation of the different elements of said alarm unit.

Redundancy is advantageously provided by connecting two hydrophones to the alarm unit. With a third hydrophone, it is possible to locate the person in difficulty in the pool. A system of hydrophones serves to ensure surveillance of beaches.

The rescue means for a swimming-pool can consist of an electrovalve which initiates draining of the water from the pool or inflation of a float for lifting a net having a rigid frame which is normally located at the bottom of the pool.

What is claimed is:

1. A system for the prevention of drowning accidents, comprising:

radio transmitter means for producing a radio signal;

at least one water-tight casing adapted to be carried by a bather and comprising a submersion detector which comprises a radio receiver for receiving said radio signal and signalling submersion when said radio signal is not received, an electronic counter activated by said submersion detector, a comparator, and an acoustic transmitter which produces acoustic waves, said submersion detector for triggering said electronic counter which is connected to said comparator which controls said acoustic transmitter, said transmitter being turned-on after the counter reaches a predetermined threshold value, and said electronic counter being reset to an initial value each time submersion is interrupted, at least one hydrophone placed in the water for picking-up any of said acoustic waves transmitted by said acoustic transmitter, means for signalling an accident when the hydrophone picks up said acoustic waves, said signalling means connected to the hydrophone by a water-tight cable.

2. A prevention system according to claim 1, wherein the submersion detector further comprises a contact which is closed by water.

3. A prevention system according to claim 1, wherein the submersion detector further comprises a pressure sensor.

4. A prevention system according to claim 1, wherein the acoustic transmitter is omnidirectional and has a sufficiently high frequency to be located outside the frequency band of swimming-pool noise.

5. A prevention system according to claim 1, wherein the signalling means comprises a selective receiver for filtering the electric signal delivered by the hydrophone.

6. A prevention system according to claim 1, wherein said hydrophone is a single hydrophone placed at the bottom of the swimming-pool for the surveillance of a private swimming-pool of small size.

7. A prevention system according to claim 1, comprising a system of hydrophones placed at the bottom of the water for the surveillance of a beach.

8. A system for the prevention of drowning accidents, comprising:

radio transmitter means for producing a radio signal;

at least one water-tight casing adapted to be carried by a bather and comprising a submersion detector which comprises a radio receiver for receiving said radio signal and signalling submersion when said radio signal is not received, an electronic counter which is activated responsive to said signaling of submersion, a comparator, and an acoustic transmitter, said submersion detector for triggering said electronic counter which is connected to said comparator which controls said acoustic transmitter, said transmitter being turned-on to transmit acoustic waves after the counter reaches a predetermined threshold value, and said electronic counter being reset to an initial value each time submersion is interrupted, said transmitter operating in a transmission frequency outside a frequency band of swimming pool noise, at least one hydrophone placed at in the water for picking-up any of said acoustic waves transmitted by said acoustic transmitter, means for signalling an accident when the hydrophone picks up said acoustic waves, said signalling means connected to the hydrophone by a water-tight cable and including a filter for eliminating swimming pool noise, and a receiver receiving an output of said filter.

9. A method for preventing drowning accidents, comprising:

providing at least one water-tight casing and causing a bather to carry said casing;

transmitting a radio wave;

detecting said casing to be submerged when said radio wave is not received;

starting an electronic counter when said radio wave is not received, due to said casing becoming submerged;

resetting said counter to an initial value each time submersion is interrupted;

comparing a value of said counter with a threshold value;

turning on an acoustic transmitter after the counter reaches a predetermined threshold value, and said electronic counter being reset;

using at least one hydrophone placed in the water to pick-up any acoustic waves transmitted by said acoustic transmitter; and signalling an accident when the hydrophone picks up said acoustic waves.

* * * * *